US008545285B2

(12) United States Patent
Fernandes

(10) Patent No.: US 8,545,285 B2
(45) Date of Patent: Oct. 1, 2013

(54) TOY WITH BUILT-IN SCHOOL PENCIL CASE

(76) Inventor: Edson Rosa Fernandes, Curitiba (BR)

( * ) Notice: Subject to any disclaimer, the term of this patent is extended or adjusted under 35 U.S.C. 154(b) by 288 days.

(21) Appl. No.: 13/054,545

(22) PCT Filed: Jul. 19, 2009

(86) PCT No.: PCT/BR2009/000212

§ 371 (c)(1),
(2), (4) Date: Jan. 18, 2011

(87) PCT Pub. No.: WO2010/006400

PCT Pub. Date: Jan. 21, 2010

(65) Prior Publication Data

US 2011/0117816 A1 May 19, 2011

(30) Foreign Application Priority Data

Jul. 18, 2008 (BR) ..... 8801674 U

(51) Int. Cl.
*A63H 17/25* (2006.01)

(52) U.S. Cl.
USPC ..... 446/470

(58) Field of Classification Search
USPC ..... 446/470, 71; 206/537, 527, 214; D3/206
See application file for complete search history.

(56) References Cited

U.S. PATENT DOCUMENTS

| | | | | |
|---|---|---|---|---|
| 4,119,249 | A * | 10/1978 | Hanson | 224/236 |
| 4,678,451 | A | 7/1987 | Ventura | |
| 4,753,346 | A | 6/1988 | Tsuji | |
| 5,441,149 | A | 8/1995 | Willard et al. | |
| 5,495,938 | A * | 3/1996 | Bedford et al. | 206/763 |
| 6,659,837 | B1 | 12/2003 | Lieberman | |

* cited by examiner

*Primary Examiner* — Gene Kim
*Assistant Examiner* — Amir Klayman
(74) *Attorney, Agent, or Firm* — Brian Pangrle

(57) ABSTRACT

"TOY WITH BUILT-IN SCHOOL PENCIL CASE" refers to the technical field of toys and school supplies, more specifically to a toy with built-in school pencil case (1). It is a toy with two utilities, with the characteristics and shape of a miniature vehicle (car or another), equipped with a practical case, that fits to a compartment located in its own interior. The car or another toy could be used for playing, as well as it could be brought to school, where the school pencil case (pencils, erasers, scissors, etc . . . ) will be drawn from its interior.

8 Claims, 4 Drawing Sheets

TOY WITH BUILT-IN SCHOOL PENCIL CASE

RELATED APPLICATIONS

This application is a 35 U.S.C. §371 National Stage of PCT/BR2009/000212 filed Sunday, Jul. 19, 2009 (published as WO2010/006400 on Jan. 21, 2010), which claims priority to BR MU8801674-9, filed Jul. 18, 2008, which was a Utility Model application (MU) filed in Brazil converted to an application for a patent of invention (PI) in Brazil and renumbered BR PI086260-9. All of the foregoing applications and publications thereof are incorporated herein by reference.

TECHNICAL FIELD

The present patent of invention refers to the technical field of toys and school supplies, more specifically to a toy with built-in school pencil case.

SUMMARY

Described herein is a toy with two utilities, with the characteristics and shape of a miniature vehicle (car or another), equipped with a practical case, that fits to a compartment located in its own interior. The car or another toy could be used for playing, as well as it could be brought to school, where the school pencil case (pencils, erasers, scissors, etc . . . ) will be drawn from its interior.

The school pencil case was built to accommodate and organize school supplies (pens, pencils, erasers, rulers, colored pencils, sharpeners, among others), that would be loose within folders and backpacks.

Currently dozens of models are available with great variety of types of layouts, configurations and materials, which are to suit all styles and tastes of children and adolescents.

The proposed model has no direct competitors, since it has an original layout, combining harmoniously the two products: toy and school pencil case.

The improvement added to the new product is the incorporation of a school pencil case and a toy. From this union, arises an extremely attractive and fun product, which will attract great interest of children, which will be able to have fun with the toy and accommodate school supplies that will be used in class. Featuring thus an ideal product to add or replace the school pencil case on the market.

Preferentially, the drawings and the descriptive report will show a toy in the shape of a car. However, the proposed model will not be limited to this configuration and may have male and female versions of models such as: boats, aircrafts, male and female dolls, among others.

The toy on its preferable form is composed by:

- A plastic carcass in the shape of a miniaturized vehicle (car), which shapes like the external part of a normal vehicle, with doors, trunk, roof, hood, bumper, windows, etc., having also interior plug-ins for fixing the chassis, and of other spots for fixing headlights, side-view mirror, among others;
- A chassis made of injected plastic, which is fit on the carcass by means of screws or pressure, having a bumper to fit and accommodate the wheels, and a parallelepiped rectangular cavity, with a system of fixed and malleable lock, to fit and fix the school pencil case;
- Other smaller plastic pieces such as: wheels, side-view mirrors, headlights and tail lights;
- A school pencil case made preferably of injected plastic, but may also be made of other materials. On its plastic version the case is formed by a lid that may be tilting or fitting, a parallelepiped rectangular body, having pyramidal side bumps, that fit the lock system of the chassis. On other versions the case may be opened by zippers or VELCRO® material.

It can be easily and practically operated by children, and consists on placing and removing the school pencil case as follows: having the case in hands, should push it into the chassis cavity, until the automatic locking of the pyramidal bumps at the lock plug-in; for removal operation, simply press the two pins of the lock until the pyramidal bumps are released and consequently the school pencil case will fall by gravity.

BRIEF DESCRIPTION OF THE DRAWINGS

The objectives, advantages and other important characteristics of the model in question will be easily understood when read together with the drawings attached, in which.

DETAILED DESCRIPTION

As it can be inferred from the attached figures that illustrate and integrate the present descriptive report of a "Toy with built-in school pencil case", it is composed by a built-in school pencil case (1), which is made by a plastic carcass (2) with miniaturized vehicle shape (car), a chassis (3) made by injected plastic, which is fitted on the carcass by means of screws or pressure, having the chassis a bumper (3A) to fit and accommodate the wheels (3B), and a internal rectangular parallelepiped cavity (3C), with a fixed or malleable lock system (3D), to fit and fix the pyramidal bumps (4A) of the school pencil case (4), being this one made preferably with injected plastic and composed by a body (4B) of parallelepiped rectangular shape, having a superior lid (4C) with tilting or sliding opening and a coupling system (4D).

Accordingly, the school pencil case (4) may be made by fabric or rubber material, with openings for VELCRO® material or a zipper(s), keeping the plastic base and the pyramidal side bumps (4A).

Accordingly, the coupling system for locking the school pencil case (4), may be of any kind.

Accordingly, the toy may present other configurations and shapes (ships, aircrafts, male or female dolls, among others), as long as it keeps the same function.

Figure 1:
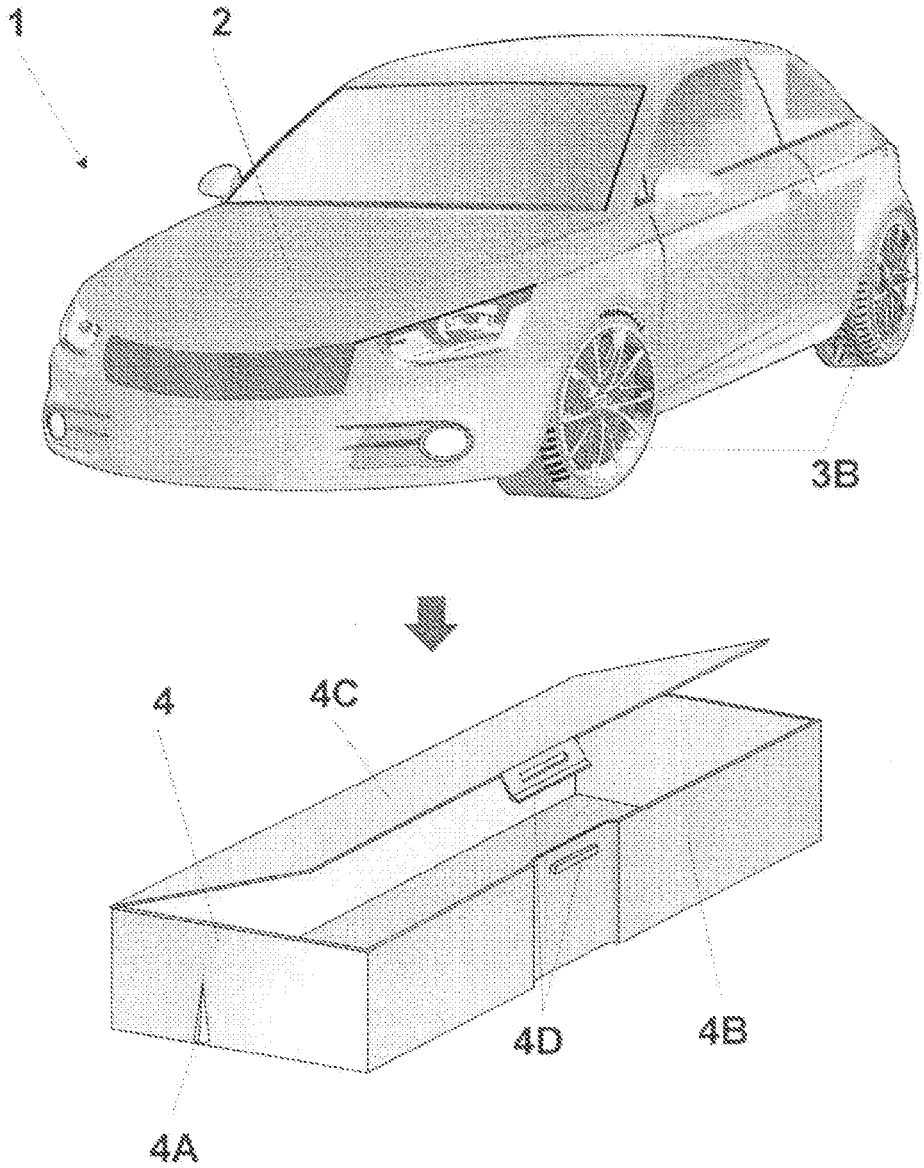
FIG. 01 shows an exploded view of the car and of the school pencil case of the toy with built-in case.
Figure 2:
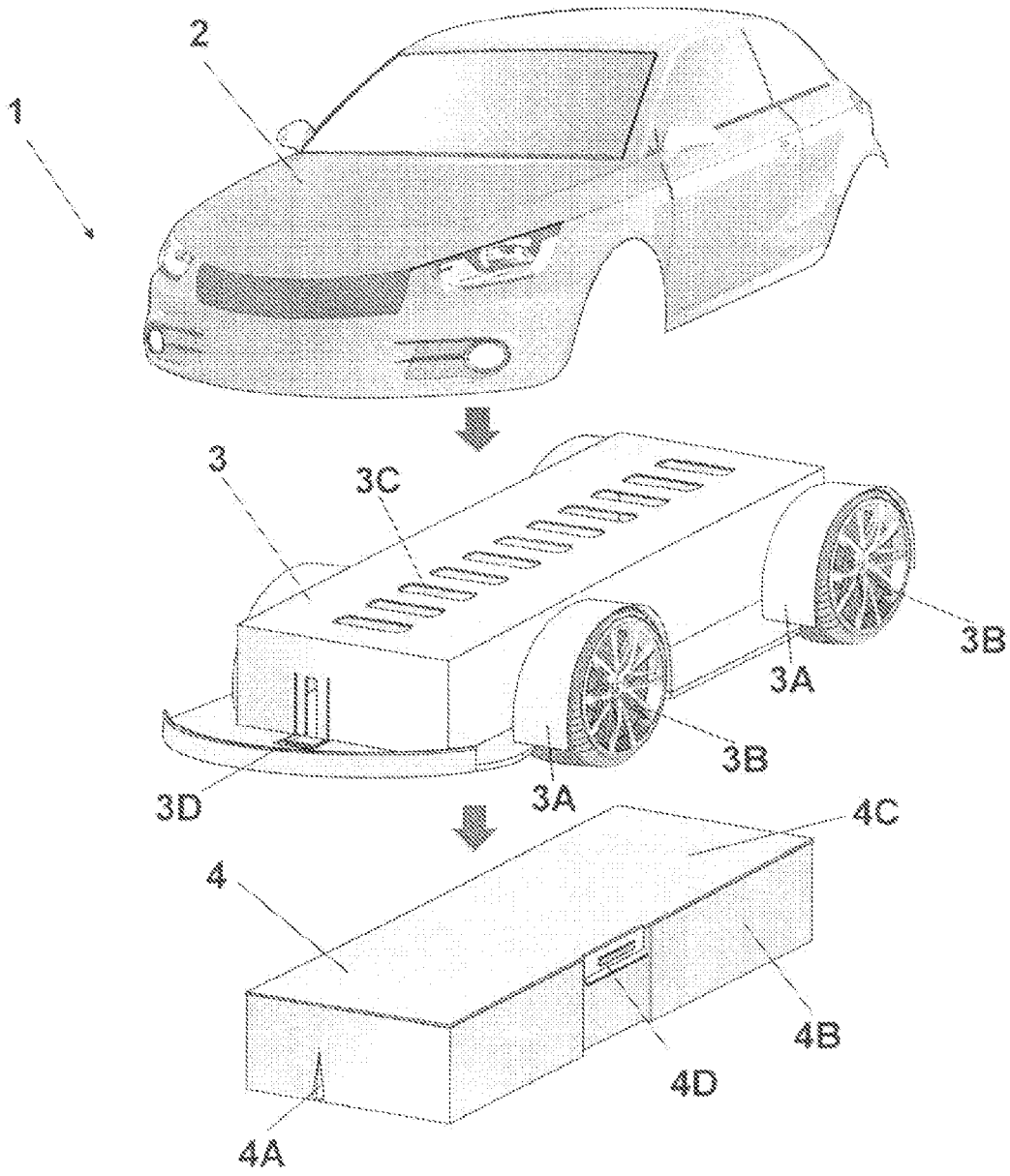
FIG. 02 shows an exploded view of the car's carcass, the chassis and the case, of the toy with built-in school pencil case.

FIGS. 01 and 02 show the toy with built-in school pencil case (1), in which they point the carcass (2) in miniaturized vehicle shape (car); the chassis (3) the fenders (3A) to fit and accommodate the wheels (3B), the internal cavity (3C), the fixed and malleable locks (3D); the pyramidal bumps (4A), of the school pencil case (4C) with tilting opening and the coupling system (4D).

Figure 3:
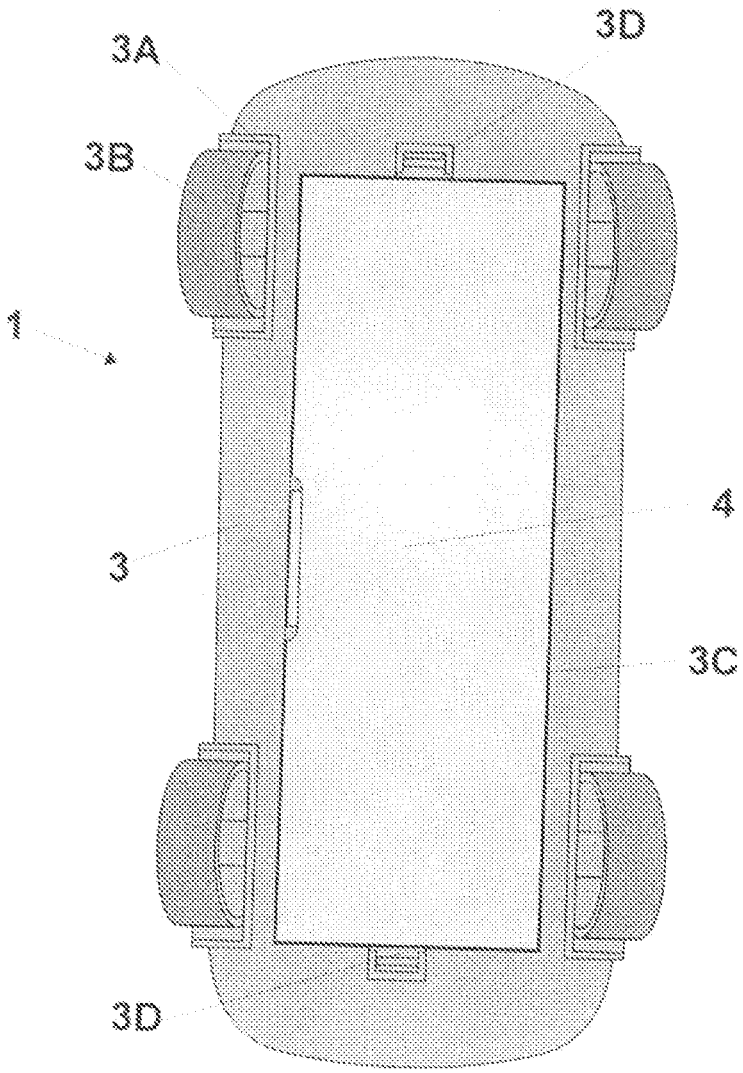
FIG. 03 shows an inferior view of the car with built-in school pencil case.

FIG. 03 shows an inferior view of the toy with built-in case for school tools (1), in which the chassis (3) is evidenced, with fenders (3A), wheels (3B), internal cavity (3C), fixed and malleable locks (3D), with pins (3D1), and the built-in school pencil case (4).

Figure 4:
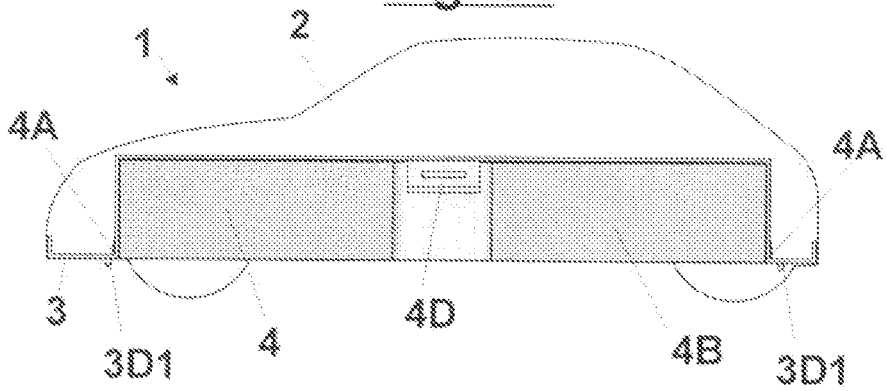
FIG. 04 shows a side sectional view of the car with built-in school pencil case.
Figure 5:
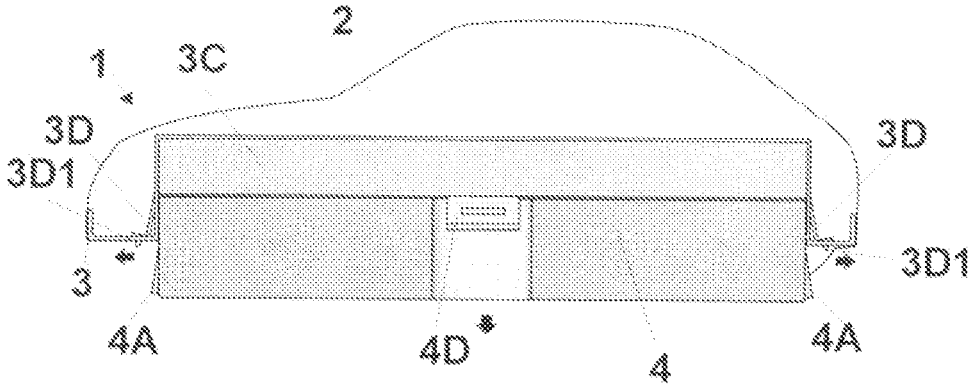
FIG. 05 shows a sectional side view of the car with built-in school pencil case, demonstrating the activation and removal of the school pencil case.
Figure 6:
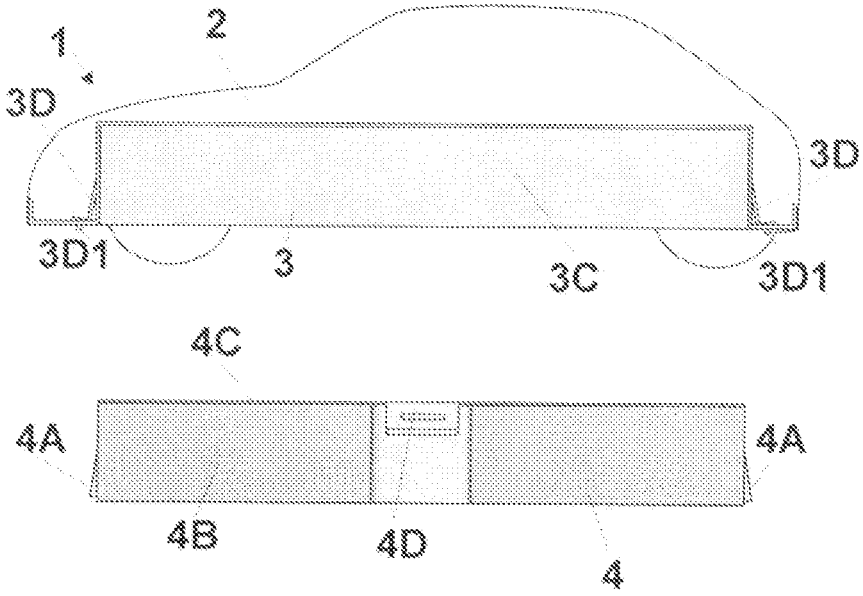
FIG. 06 shows sectional side view of the car with built-in school pencil case, with its case removed.

FIGS. 04, 05 and 06 show the accommodation and the removal process of the school pencil case (4) from inside the toy (car).

This product was designed to diversify the school pencil case market and provide more joy for children using a double utility product.

These attributes allow classifying the toy with built-in school pencil case (1), a completely versatile product, efficient and practical, to accommodate school supplies, as much as to bring joy to the children.

The invention claimed is:

1. A toy comprising:

a plastic carcass (2) with a miniaturized vehicle shape;

a pencil case (4) that comprises a body (4B) that comprises four lateral sides and an inferior base in a parallelepiped rectangular shape that form a cavity having a superior opening, and pyramidal bumps (4A) angled outwardly from two respective opposing sides of the lateral sides of the body (4B) to form respective inferior bases, a superior lid (4C) shaped to cover the superior opening of the body (4B), and a coupling system (4D) to couple the superior lid (4C) in a closed position with respect the superior opening of the body (4B); and a chassis (3) fitted to the carcass (2) wherein the chassis (3) comprises wheels (3B), walls forming an internal rectangular parallelepiped cavity (3C) having an inferior opening for receipt of the pencil case (4), and a malleable lock system (3D) for automatic locking and selective unlocking of the pencil case (4) with respect to the chassis (3) wherein the malleable lock system (3) comprises two opposing malleable tabs wherein each of the tabs comprises an opening to fit and releasably fix a respective one of the pyramidal bumps (4A) of the pencil case (4) to lock the pencil case (4) in the internal rectangular parallelepiped cavity (3C) with the superior lid (4C) of the pencil case (4) disposed superiorly and the inferior base of the body (4B) of the pencil case (4) disposed inferiorly.

2. The toy of claim 1 wherein the plastic carcass (2) comprises an injection molded plastic carcass formed by injecting plastic into a mold.

3. The toy of claim 1 wherein the carcass (2) and the chassis (3) are pressure fitted to each other.

4. The toy of claim 1 wherein the carcass (2) and the chassis (3) are fitted to each other by means of screws.

5. The toy of claim 1 wherein the superior lid (4C) is configured to provide access to an interior of the pencil case (4) by tilting or sliding.

6. The toy of claim 1 wherein the pencil case (4) comprises a fabric or rubber material.

7. The toy of claim 1 wherein the coupling system (4D) comprises VELCRO® material or one or more zippers.

8. The toy of claim 1 wherein the chassis (3) accommodates a different carcass with a different miniaturized vehicle shape of a vehicle that comprises doors, a roof and a hood.

* * * * *